US006882330B2

(12) United States Patent
Moon

(10) Patent No.: US 6,882,330 B2
(45) Date of Patent: Apr. 19, 2005

(54) FIELD EMISSION DISPLAYING DEVICE AND DRIVING METHOD THEREOF

(75) Inventor: Seong Hak Moon, Kyeongki-Do (KR)

(73) Assignee: LG Electronics Inc., Seoul (KR)

( * ) Notice: Subject to any disclaimer, the term of this patent is extended or adjusted under 35 U.S.C. 154(b) by 357 days.

(21) Appl. No.: 10/103,755

(22) Filed: Mar. 25, 2002

(65) Prior Publication Data

US 2002/0196210 A1 Dec. 26, 2002

(30) Foreign Application Priority Data

Mar. 26, 2001 (KR) ..... 2001-15751
Mar. 26, 2001 (KR) ..... 2001-15752
May 16, 2001 (KR) ..... 2001-26619

(51) Int. Cl.[7] ..... G09G 3/22
(52) U.S. Cl. ..... 345/75.2; 345/76; 315/169.3
(58) Field of Search ..... 345/204, 75.2, 345/76, 77, 74.1, 78, 87, 88, 89, 90, 93, 95, 96, 99, 54, 98, 100; 315/169.3, 169.4

(56) References Cited

U.S. PATENT DOCUMENTS 5,767,823 A * 6/1998 Hush ..... 345/55
5,814,946 A * 9/1998 Hall et al. ..... 315/169.1
6,166,490 A * 12/2000 Hansen ..... 315/169.1
6,195,196 B1 * 2/2001 Kimura et al. ..... 359/295
6,204,834 B1 * 3/2001 Baker et al. ..... 345/75.2
6,340,962 B1 * 1/2002 Konishi ..... 345/75.2
6,366,266 B1 * 4/2002 Zhang et al. ..... 345/74.1
6,587,087 B1 * 7/2003 Ishizuka ..... 345/82

* cited by examiner

*Primary Examiner*—Binpin Shalwala
*Assistant Examiner*—Mansour M. Said
(74) *Attorney, Agent, or Firm*—Fleshner & Kim, LLP

(57) ABSTRACT

A field emission display device includes: a reset driving unit for supplying a reset pulse to a scan line and a scan driving unit for supplying a scan pulse to the scan line. The reset driving unit includes a first reset drive IC for receiving a first reset data from a reset data supplying unit, a second reset drive IC for receiving a second reset data from the reset data supplying unit and a first switch connected to the first reset drive IC and turned on/off by the second reset drive IC.

16 Claims, 11 Drawing Sheets

FIELD EMISSION DISPLAYING DEVICE AND DRIVING METHOD THEREOF

BACKGROUND OF THE INVENTION

1. Field of the Invention

The present invention relates to a field emission displaying device and its driving method, and more particularly to a field emission displaying device in which a scan pulse is supplied to a scan line and a data pulse is supplied to a data line so as to drive each cell of display device according to a voltage difference between the scan pulse and the data pulse, and its driving method.

2. Description of the Background Art

Recently, various flat display devices that are capable of reducing a weight and volume of a cathode ray tube (CRT) are being developed.

The flat display devices include a liquid crystal display, a field emission display (FED), a plasma display panel and an electro-luminescence, and in order to improve a display quality of those flat display devices, researches and developments are being actively conducted to heighten a luminance, a contrast and a color purity.

Among them, the FED includes a tip type FED that emits electrons by using a tunnel effect by concentrating a high electric field to an acute emitter, and a flat type FED that emits electrons by concentrating a high electric field to a metal having a certain area.

In the tip type FED, a voltage is supplied to a gate electrode to apply an electric field to an electron emitting portion, so that electrons are emitted from a conic protrusion portion made of silicon or molybdenum.

Meanwhile, the flat type FED has a structure that a metal layer, an insulation layer and a semiconductor layer are stacked, and electrons are injected to pass the insulation layer by using the tunnel effect from the metal layer and emitted outwardly from an electron emitting unit.

As for the tip type FED, an electron emission amount is determined according to the characteristics of an emitter used for the electron emission.

Thus, emitters are to be fabricated to be uniform, but with the current fabricating process, it is not easy to fabricate emitters exactly the same with each other and much time is consumed for the process for fabricating the emitters.

In addition, since electrons are emitted from the acute emitter, scores of bolt and hundreds of bolt voltage should be applied to a cathode electrode and a gate electrode, causing a problem of much power consumption.

FIG. 1 is a drawing illustrating a cell of a flat type FED in accordance with a conventional art.

As shown in FIG. 1, each cell of the flat type FED includes an upper substrate 101 on which an anode electrode 102 and a fluorescent material 103 are stacked, and a field emission array 105 formed on a lower substrate.

The field emission array 105 includes a scan electrode 108 formed on the lower substrate, an insulation layer 107 formed on the scan electrode 108 and a data electrode 105 formed on the insulation layer 107.

The scan electrode 108 supplies current to the insulation layer 107. The insulation layer 107 insulates the scan electrode 108 and the data electrode 106. The data electrode 106 is used as a fetch electrode for fetching electrons.

The flat type FED in accordance with the conventional art constructed as described above will now be explained.

In order for a picture to be displayed on the display device, first, a scan pulse of a negative (−) polarity is applied to the scan electrode 108 and a data pulse of positive (+) polarity is applied to the data electrode 106. And an anode voltage of positive polarity (+) is applied to the anode electrode (102).

Then, electrons are accelerated toward the anode electrode 102 after tunneling from the scan electrode 108 to the data electrode 106 and to the insulation layer 107.

The electrons collide with the fluorescent material 103 of red, green and blue color and excite the fluorescent material 103.

At this time, a visible ray of one of red, green and blue color is generated according to the fluorescent material 103.

Since the scan electrode 108 and the data electrode 106 are installed facing each other with a certain area, the flat type FED can be driven at a lower voltage compared to the tip type FED.

In other words, since only a few V to 10 V voltage is applied to the scan electrode 108 and the data electrode 106 of the flat type FED and the scan electrode 108 and the data electrode 106 emitting electrons have a certain area, the scan electrode 108 and the data electrode 106 can be fabricated by a simple process compared to the tip type FED.

FIG. 2 is a drawing illustrating driving waveforms supplied to the FED in accordance with the conventional art.

As shown in FIG. 2, a scan pulse (SP) of negative polarity is sequentially supplied to scan lines (S1, S2, . . . , Sm) of the conventional FED, and a data pulse (DP) of positive polarity synchronized with the scan pulse (SP) of negative polarity is supplied to a data line (D).

Electrons are emitted from the cell where the scan pulse (SP) and the data pulse (DP) have been supplied, by a voltage difference between the scan pulse (SP) and the data pulse (DP).

FIG. 3 is a drawing illustrating a cell arrangement of a general FED.

As shown in FIG. 3, if −5V scan pulse (SP) is applied to a first scan line (SI) and 5 v data pulse (DP) is applied to the data line (D), 10 V of voltage difference occurs at the first cell (P1) formed at the first scan line (S1). Accordingly, electrons are emitted from the first cell (P1) to which the data pulse (DP) has been supplied.

Meanwhile, only 5V of data pulse (DP) is applied to the second through mth cells (P2 through Pm) formed at the mth scan line (S2 through Sm), no electrons are emitted.

Thereafter, the above process is repeatedly performed to sequentially apply the scan pulse (SP) and the data pulse (DP) up to the mth scan line (Sm), so as to drive the first through the mth cells (P1, P2, . . . , Pm) and display a picture on the display device.

After the picture is displayed, a reset pulse (RP) of positive polarity is applied to the first through the mth scan lines (S1, S2, . . . , Sm). Then, electric charges charged in the first through the mth cells (P1 through Pm) are removed.

However, in the conventional flat type FED, when the first scan line is driven, the data pulse is applied also to the second through the mth scan lines. A certain voltage is applied to the second through the mth scan lineswhich have received the data pulse, and a capacitance value of the cells becomes great due to the certain voltage. This phenomenon also occurs when the cells formed at the second through the mth scan lines are driven.

In other words, in the conventional flat type FED, when the scan pulse is applied to one scan line, since the data pulse is applied to every scan line, the cells are not uniform. When the cells are operated in a state that they are not uniform, a picture quality of the FED is degraded.

In addition, the driving speed is degraded due to the value of the capacitance charged in the cells that are not operated, so that the driving efficiency is degraded.

Moreover, the reset pulse (RP) is simultaneously applied as a square wave to the first through the mth scan lines (S1, S2, . . . , Sm). In this respect, since the flat type FED is formed in a capacitor structure including a metal layer, an insulator layer and a metal layer, it has a great capacitor component and a diode quality, a displacement current having a great instantaneous peak value flows in a reset output wave current applied to the cell.

The displacement current causes a breakdown of the insulation layer 108 between the scan electrode 108 and the data electrode 106 only to shorten a durability of the electrode and damage a driving IC for driving the FED.

In addition, a displacement current having a great peak value increases a reactive power that is not contributed to emitting, causing a problem of a power loss.

SUMMARY OF THE INVENTION

Therefore, an object of the present invention is to provide a field emission displaying apparatus and method in which uniformity of cell is obtained by supplying a reset pulse to every scan line after supplying a scan pulse to one scan line and since every cell is driven in a uniform state, a picture quality and an efficiency of a field emission display device are improved.

Another object of the present invention is to provide a field emission display device and method that is capable of increasing a durability of a cell by preventing a damage of an insulation layer between a data electrode and a scan electrode by reducing a displacement current of an instantaneous peak current applied to the cell by applying a lamp type reset pulse with a slope to the scan line, and capable of preventing breakdown of a device of a driving IC.

Still another object of the present invention is to provide a field emission display device and method that is capable of reducing a power consumption by performing a reset operation without a reset pulse and extending a durability of an electrode by preventing an insulation breakdown of a cell.

To achieve these and other advantages and in accordance with the purpose of the present invention, as embodied and broadly described herein, there is provided a field emission display device including: a reset driving unit for supplying a reset pulse to a scan line and a scan driving unit for supplying a scan pulse to the scan line.

To achieve the above objects, there is also provided a driving method of a field emission display device including the steps of: sequentially supplying a scan pulse to a plurality of scan lines; supplying a data pulse to a plurality of data lines in synchronization with the scan pulse, and supplying a plurality of reset pulses to the plurality of scan lines in order to remove an electric charge charged in a cell where the scan pulse and the data pulse-have been supplied.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A driving method of a field emission display device in accordance with the present invention solves problems of the conventional art by constantly controlling a scan pulse and a reset pulse supplied to a scan line.

Figure 4:
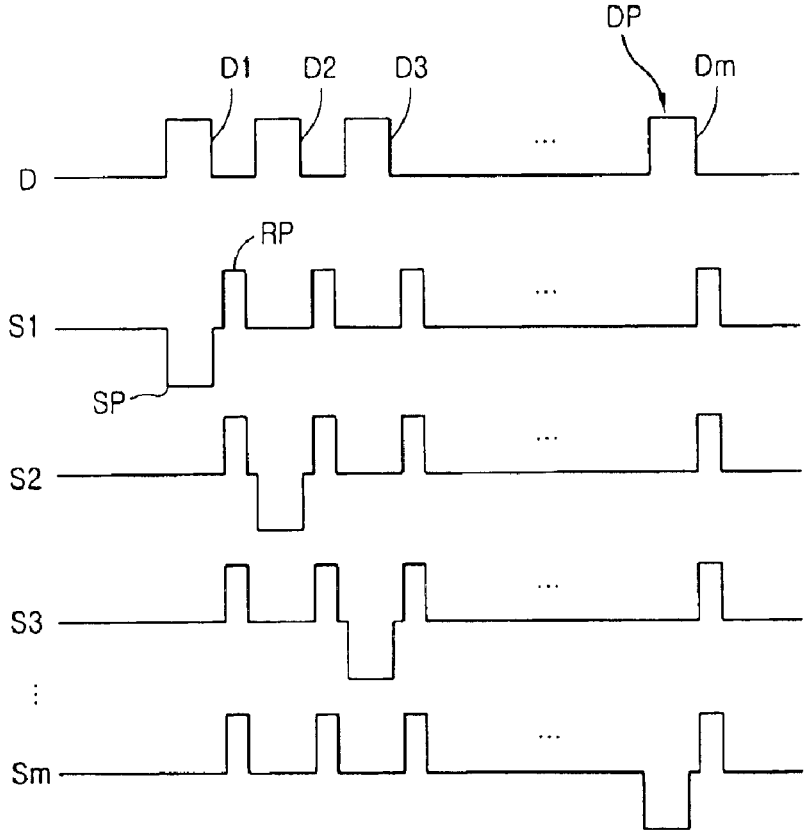
FIG. 4 is a drawing illustrating waveforms according to a driving method of a field emission display device in accordance with a first embodiment of the present invention.

FIG. 4 is a drawing illustrating waveforms according to a driving method of a field emission display device in accordance with a first embodiment of the present invention.

As shown in FIG. 4, a scan pulse (SP) of negative polarity is sequentially supplied to scan lines (S1, S2, . . . , Sm) of an FED, and a data pulse (DP) of positive polarity synchronized with the scan pulse (SP) is supplied to data lines (D1, D2, . . . , Dm). Whether the data pulse (DP) is to be applied or not to the data lines (D1, D2, . . . , Dm) is determined on a picture to be displayed.

After the data pulse is supplied to the data lines (D1, D2, . . . , Dm), a reset pulse (RP) is supplied to every scan line (S1, S2, . . . , Sm). The reset pulse (RP) is supplied between the scan pulse (SP) supplied to one scan line (Si) and a scan pulse (SP) supplied to the next scan line (Si+1).

For example, when −5V scan pulse (SP) is applied to a first scan line (S1) and 5V data pulse (DP) is applied to the data lines (D1, D2, . . . , Dm), 10V of voltage difference occurs in the first cells formed at the first scan line (S1). Accordingly, electrons are emitted from the first cells to which the data pulse (DP) has been supplied.

At this time, width and/or amplitude of the data pulse (DP) is set differently depending on a gradation. For example, when a high gradation is expressed, a width and/or amplitude of the data pulse (DP) is set wide or high, and when a low gradation is expressed, a width and/or amplitude of the data pulse (DP) is set narrow or low. Thereafter, the reset pulse (RP) is commonly applied to the first through the mth scan lines (S1, S2, . . . , Sm).

After the scan pulse of the first scan line (S1) is generated, when the reset pulse (RP) is supplied to every scan lines (S1, S2, . . . , Sm), the electric charges charged in the every scan line (S1, S2, . . . , Sm) when the scan pulse of the first scan line (S1) was generated are removed.

In other words, after a scan pulse of one scan line (S1) is generated, a uniformity of a cell can be accomplished by removing the electric charges charged in every cell. In addition, by removing a residual electric charges of every cell, a driving speed and efficiency of the FED can be improved.

Figure 5:
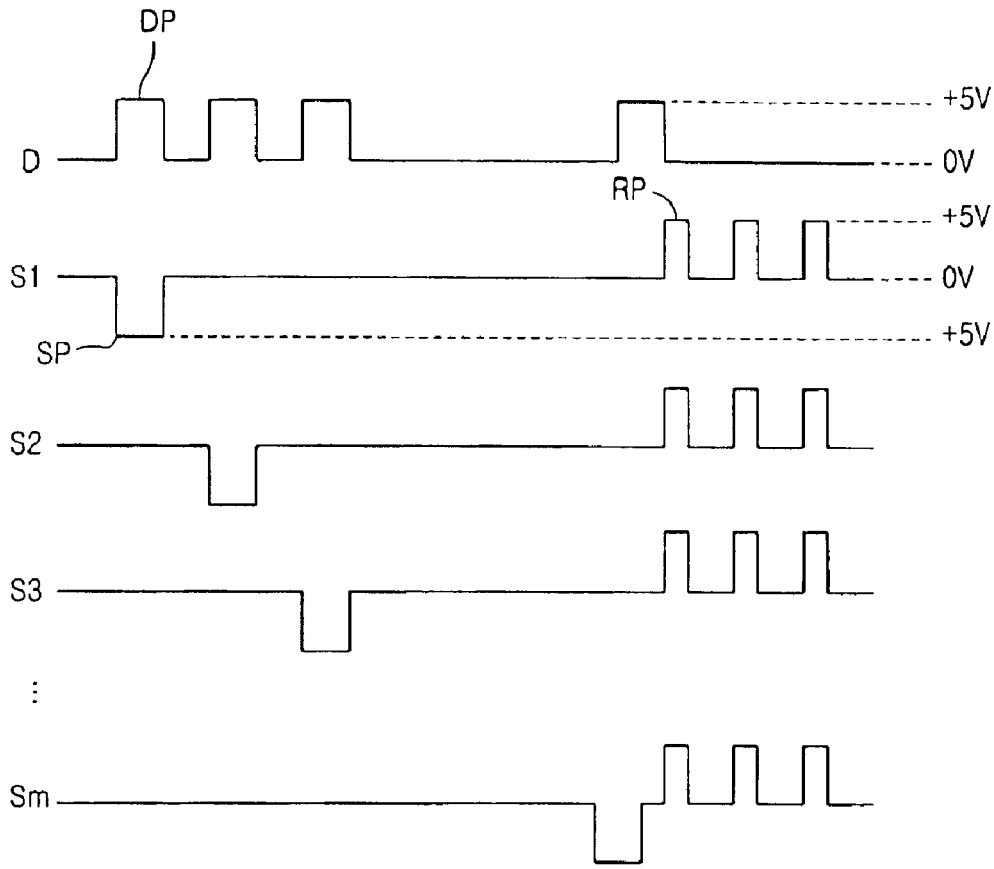
FIG. 5 is a drawing illustrating waveforms according to a driving method of a field emission display device in accordance with a second embodiment of the present invention.

FIG. 5 is a drawing illustrating waveforms according to a driving method of a field emission display device in accordance with a second embodiment of the present invention.

As shown in FIG. 5, a scan pulse (SP) of negative polarity is sequentially supplied to the scan lines (S1, S2, . . . , Sm) of the FED and a data pulse (DP) of positive polarity synchronized with the scan pulse (SP) is supplied to the data lines (D1, D2, . . . , Dm).

After the scan pulse (SP) is sequentially supplied to every scan line (S1, S2, . . . , Sm), at least more than 2 reset pulses (RP) are supplied to the scan lines. Then, the residual electric charges of the cells are all removed, so that a uniformity of the cell can be improved.

Figure 6:
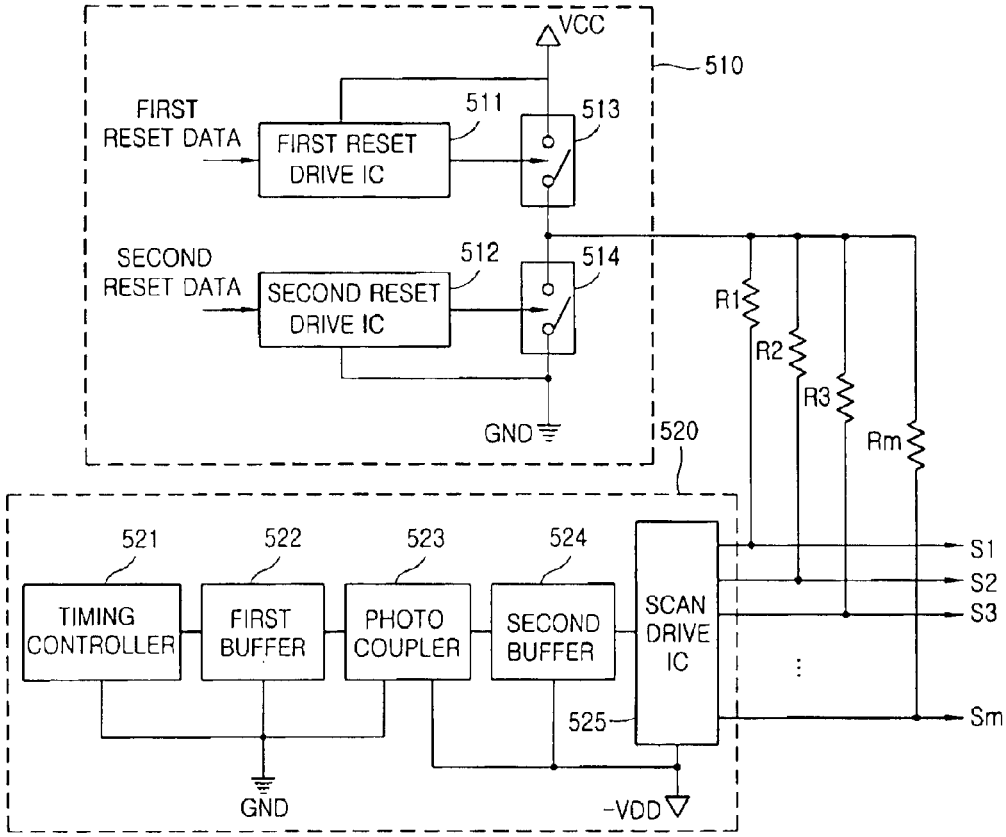
FIG. 6 is a schematic block diagram showing a driving circuit for generating driving waveforms at each scan line in accordance with the present invention.

FIG. 6 is a schematic block diagram showing a driving circuit for generating driving waveforms at each scan line in accordance with the present invention.

As shown in FIG. 6, the driving circuit includes a reset driving unit (510) for supplying the reset pulse (RP) to the scan lines (S1, S2, . . . , Sm) and a scan driving unit (520) for supplying the scan pulse (SP) to the scan lines (S1, S2, . . . , Sm).

The scan driving unit 520 includes: a timing controller 521 for supplying a scanning data according to a supply timing of the scan pulse (SP); a first buffer 522 for temporarily storing the scanning data; a photocoupler 523 for electrically insulating the first buffer 522 and a second buffer 524 (to be described); and a second buffer 524 for temporarily storing the scanning data received from the photocoupler 523; and a scan drive integrated circuit (IC) 525 for receiving the scanning data from the second buffer 524 and sequentially supplying the scan pulse (SP) to the scan lines (S1, S2, . . . , Sm).

The scan driving unit 520 will now be described in detail.

The timing controller 521, the first buffer 522 and the photocoupler 523 are connected to a ground (GND), and the photocoupler 523, the second buffer 524 and the scan drive IC 525 receive a voltage of negative polarity from a fixed voltage source (VDD).

Then, the timing controller supplies a scanning data to the first buffer 522 in certain intervals so that the scan pulse (SP) can be sequentially supplied to the scan lines (S1, S2, . . . , Sm).

The first buffer 522 temporarily stores the scanning data and supplies the stored data to the photocoupler 523. The photocoupler 523 supplies the data received form the first buffer 522 to the second buffer 524.

The second buffer 524 temporarily stores the scanning data supplied from the photocoupler 523 and supplies the stored data to the scan driver IC 525.

The scan drive IC 525 includes a plurality of switching devices, and one of the switching devices is turned on by the scanning data supplied from the second buffer 524 and supplies the scan pulse (SP) to the scan lines (S1, S2, . . . , Sm).

Meanwhile, a shift register may be additionally installed between the second buffer 524 and the scan drive IC 525. The shift register sequentially drives the plurality of switches included in the scan drive IC 525.

The reset driving unit 510 includes a first reset drive IC 511 for receiving a 5 first reset data from an external source; a second reset drive IC 512 for receiving a second reset data; a first switching device 513 driven by the first reset drive IC 511 and the second switching device 514 driven by the second reset drive IC 512.

The reset driving unit 510 constructed as described above will now be explained.

The first reset drive IC 511 and the first switching device 513 are connected to an external voltage source (VCC), and the second reset drive IC 512 and the second switching device 514 are connected to the ground (GND).

Then, the first reset drive IC 511 supplies a control signal to the first switching device 513 when it receives the first reset data. The first switching device 513 is turned on by the control signal supplied from the first reset drive IC 513 and supplies a voltage of the external voltage source (VCC) to the scan lines (S1, S2, . . . , Sm). At this time, the reset pulse (RP) of positive polarity is supplied to the scan lines (S1, S2, . . . , Sm).

In order to generate driving waveforms as shown in FIG. 4, after the scan pulse (SP) is supplied from the scan driving unit 520 to one scan line (Si), the first reset drive IC 511 turns on the first switching device 513, for which the first reset data as many as the scan pulses (SP) are supplied to the first reset drive IC 511.

In order to generate driving waveforms as shown in FIG. 5., the first reset drive IC 511 turns on the second switching device 514 at least more than twice after the scan pulse (SP) is supplied to every scan line (S1, S2, . . . , Sm) from the scan driving unit 520, for which at least more than two first reset data are supplied to the first reset drive IC 512.

The second reset drive IC 514 supplies a control signal to the second switching device 514 when it receives the second reset data.

The second switching device 514 is turned by the control signal supplied from the second reset drive IC 512 and connects the ground (GND) to the scan lines (S1, S2, . . . , Sm). At this time, a ground voltage is supplied to the scan lines (S1, S2, . . . , Sm).

In addition, when the scan pulse (SP) and the reset pulse (RP) are not supplied to the scan lines (S1, S2, . . . , Sm), the second reset drive IC 512 turns on the second switching device 514.

Figure 7:
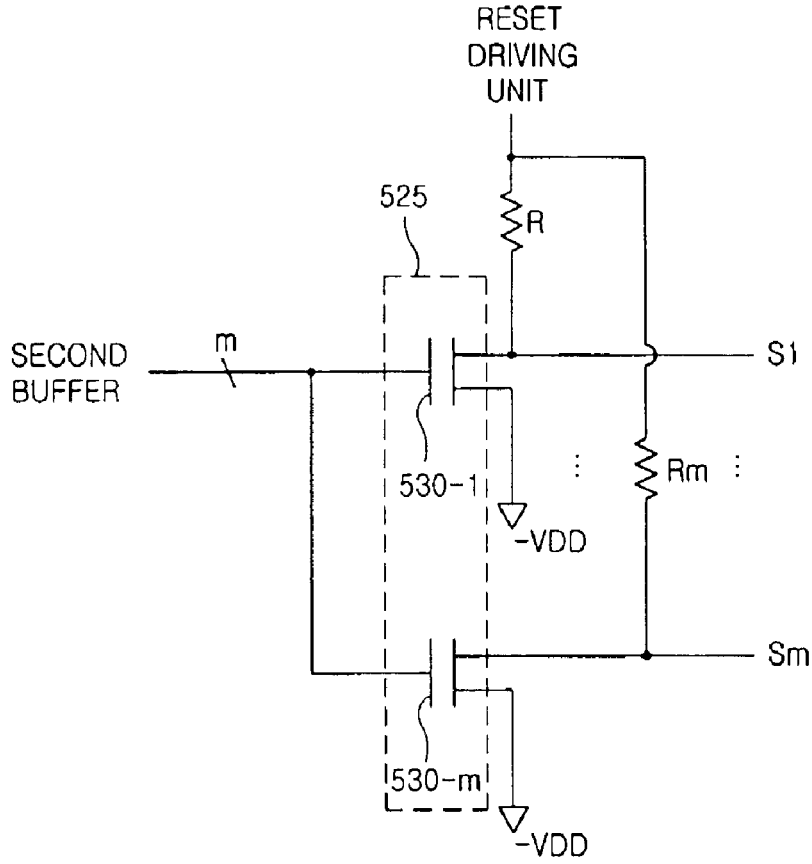
FIG. 7 is a circuit diagram showing a plurality of switching devices included in a scan drive IC of FIG. 6.

The plurality of switching devices (530-1, 530-2, . . . , 530-M) included in the scan drive IC 525 can be constructed as shown in FIG. 7.

FIG. 7 is a circuit diagram showing a plurality of switching devices included in a scan drive IC of FIG. 6.

As shown in FIG. 7, gate electrodes of the switching devices (530-1, 530-2, . . . , 530-M) included in the scan drive IC 525 are connected to the second buffer 524 or to a shift register (not shown).

Drain electrodes of the switching devices (530-1, 530-2, . . . , 530-M) are connected to the reset driving unit 510, and source electrodes are connected to a fixed Voltage source (−VDD) of negative polarity.

Resistances (R1, R2, . . . , Rm) are installed between the drain electrodes of the switching devices (530-1, 530-2, . . . , 530-M) and the reset driving unit 510.

Figure 8:
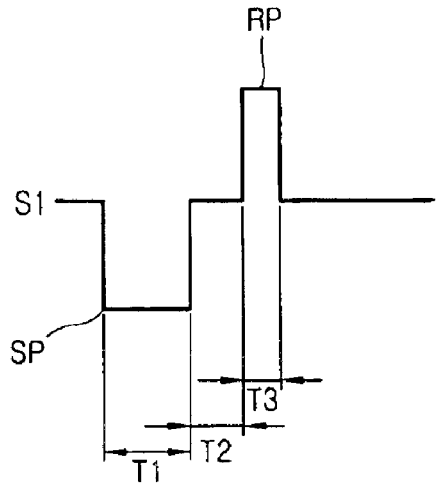
FIG. 8 is a detailed view of the waveforms of FIG. 4.

The operation of the switching devices (530-1, 530-2, . . . , 530-M) will now be described with reference to the pulse waveforms as shown in FIG. 8.

First, the switching devices (530-1, 530-2, . . . , 530-M) receive a scanning data from the scan drive IC 525. The scanning data is supplied to only one of the plurality of switching devices (530-1, 530-2, . . . , 530-M) included in the scan drive IC 525.

Upon receipt of the scanning data, the switching devices are turned on, respectively. At this time, the first and second switching devices 513, 514 of the reset driving unit 510 are maintained in an OFF state.

When the switching devices (530-1, 530-2, . . . , 530-M) are turned on, respectively, the voltage of negative polarity (−VDD) is supplied to the first scan line (S1).

That is, the scan pulse (SP) of negative polarity is supplied to the first scan line (S1) for the interval of T1.

After the reset pulse (RP) of negative polarity is supplied to the first scan line (S1) for the interval of T1, the switching device 530-1 is turned off.

When the switching device 530-1 is turned off, the second switch 514 of the reset driving unit 510 is turned on.

When the second switch 514 is turned on, the ground voltage is supplied to every scan line (S1, S2, . . . , Sm).

That is, the scan lines (S1, S2, . . . , Sm) maintain the ground for the interval of T2.

Thereafter, the second switch 514 of the reset driving unit 510 is turned off, the first switch 513 is turned on.

When the first switch 513 is turned on, the voltage of the external voltage source (Vcc) is supplied to the scan lines (S1, S2, . . . , Sm).

Accordingly, since the reset pulse (RP) is supplied to every scan lines (S1, S2, . . . , Sm), a uniformity of each cell can be accomplished.

Figure 9:
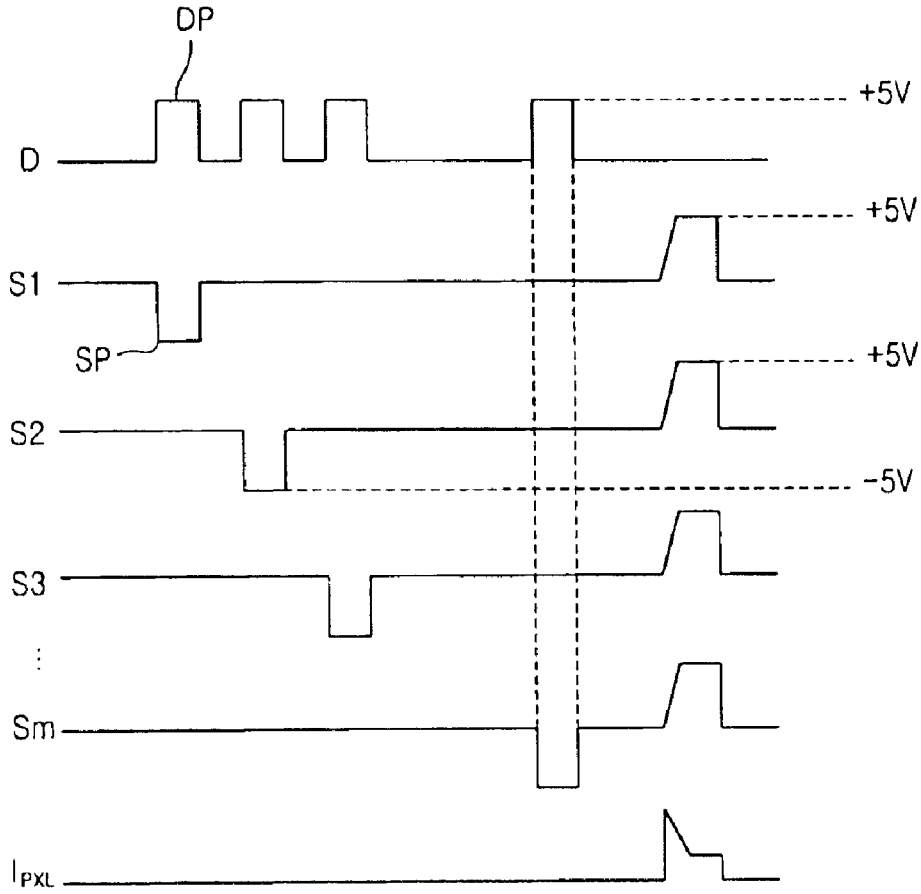
FIG. 9 is a drawing illustrating waveforms according to a driving method of a field emission display device in accordance with a third embodiment of the present invention.

FIG. 9 is a drawing illustrating waveforms according to a driving method of a field emission display device in accordance with a third embodiment of the present invention.

As shown in FIG. 9, scan pulse (SP) of negative polarity is sequentially supplied to the scan liens (S1, S2, . . . , Sm) of the FET and a data pulse (DP) of positive polarity synchronized with the scan pulse (SP) of negative polarity is supplied to the data line (D).

Electrons are emitted from the cell to which the scan pulse (SP) and the data pulse (DP) have been supplied, due to the voltage difference between the scan pulse (SP) and the data pulse (DP).

The driving waveforms will now be described in detail with reference to the accompanying drawings.

First, when the scan pulse (SP) of negative polarity is applied to the first scan line (S1) and the data pulse (DP) of positive polarity is supplied to the data line (D), a voltage difference between the scan pulse (SP) and the data pulse (DP) occurs at the first cells (P1).

Thus, electrons corresponding to the potential difference are emitted from the discharge cells to which the data pulse (DP) has been supplied, among the first cells (P1).

Meanwhile, the width and amplitude of the data pulse (DP) are differently supplied depending on a degradation. At this time, since only the data pulse (DP) of positive polarity are applied to the second through the nth cells (P2 through Pn) formed at the second through the nth scan lines (S2 through Sm), no electrons are emitted.

By repeatedly performing the above process, the scan pulse (SP) and the data pulse (DP) are sequentially applied up to the mth scan line (Sm) to drive the first through the mth cells (P1, P2, . . . , Pm) to display a picture.

After displaying the picture, the first through the mth cells (P1, P2, . . . , Pm) are driven to display a picture.

After displaying the picture, a lamp type reset pulse (RP) of positive polarity is applied to the first through the mth scan lines (S1, S2, . . . , Sm).

When the lamp type reset pulse (RP) is applied to the first through the mth scan lines (S1, S2, . . . , Sm), the electric charges charged in the first through the mth cells (P1, P2, . . . , Pm) are removed.

The lamp type reset pulse (RP) is simultaneously applied to the all scan lines (S1, S2, . . . , Sm) and has a certain climbing slope in consideration of a capacity impedance of the cell so that no instantaneous peak current can flow to the cell.

Figure 1:
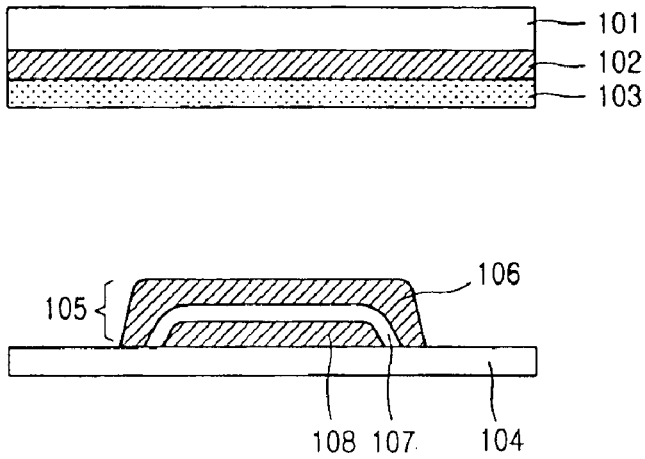
FIG. 1 CONVENTIONAL ART
FIG. 1 is a drawing illustrating a cell of a flat type FED in accordance with a conventional art.
Figure 2:
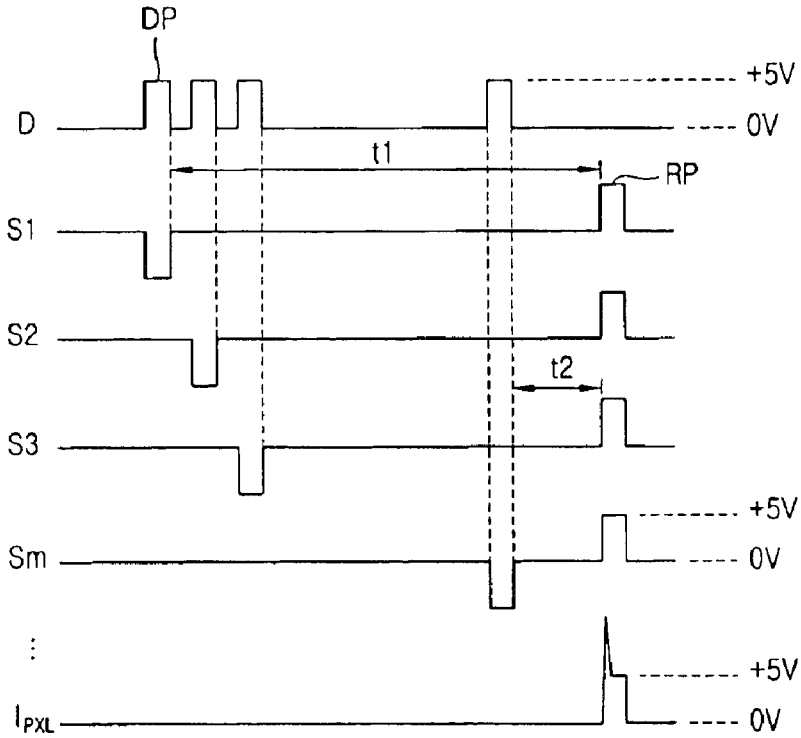
FIG. 2 CONVENTIONAL ART
FIG. 2 is a drawing illustrating driving waveforms supplied to the FED in accordance with the conventional art.
Figure 3:
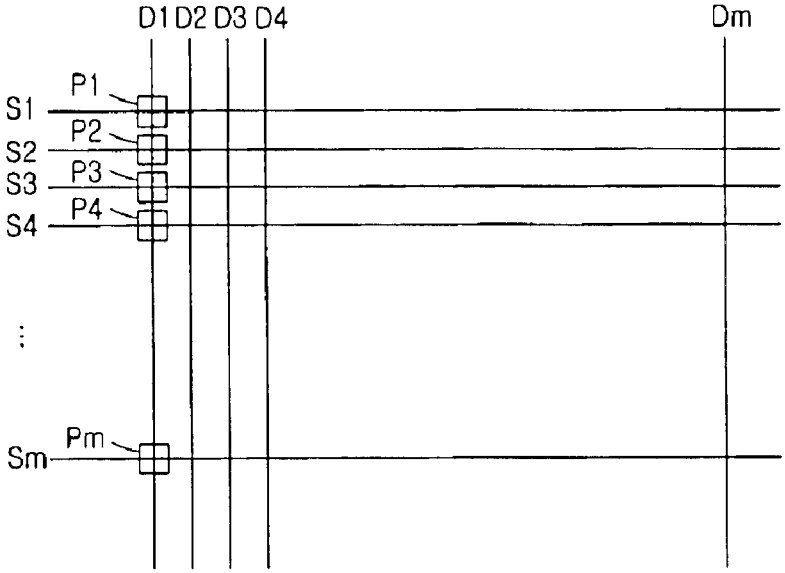
FIG. 3 CONVENTIONAL ART
FIG. 3 is a drawing illustrating a cell arrangement of a general field emission display device.

When the lamp type reset pulse (RP) is applied for a certain period, since the scan voltage is gradually supplied to the cell, the maximum value of current (lpxl) applied to the cell is reduced less than the pulse of the peak value generated by the square wave as in the conventional art as shown in FIG. 2.

Figure 10:
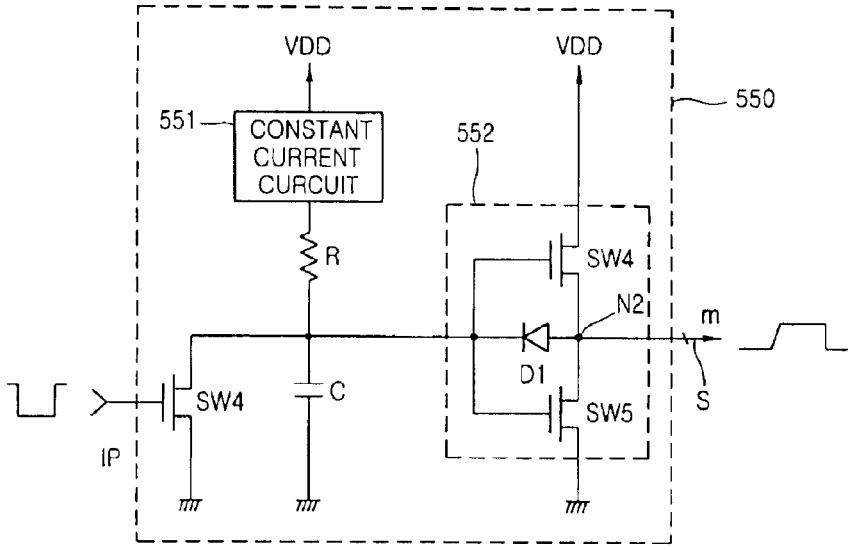
FIG. 10 is a circuit diagram showing a reset pulse generating unit for generating a reset pulse of an FET of FIG. 9.

FIG. 10 is a circuit diagram showing a reset pulse generating unit for generating a reset pulse of an FET of FIG. 9.

As shown in FIG. 10, the reset pulse generating unit 550 includes: a fourth switch SW4 for receiving an input pulse (IP); a resistance (R) and a capacitor (C) connected in parallel to the fourth switch (SW4); a constant current circuit 551 for supplying a constant current to the resistance (R); and a third drive IC 552 for selectively supplying the supply power (VDD) and the ground (GND) to the scan lines (S1, S2, . . . , Sm) in response to the voltage from the first node 1.

At this time, the reset pulse generating unit 550 may be substituted by the reset driving unit 510 as shown in FIG. 6 and connected, or may be connected to the next stage of the reset driving unit 510.

The fourth switch SW4, fabricated as an N channel MOSFET, is turned on in the high logic section of the input pulse (IP) and turned off in the low logic section of the input pulse (IP).

As the fourth switch (SW4) is turned on, the voltage on the first node is discharged toward the ground (GND), and thus, its level becomes low.

And, as the fourth switch (SW4) is turned off, the capacitor (C) charges a voltage, for which, in the fourth switch, an input pulse (IP) is applied to the gate terminal and ground voltage (GND) is applied to the source terminal. The drain terminal of the fourth switch (SW4) is connected to the first node (N1) between the resistance (R) and the capacitor (C).

The resistance (R) and the capacitor (C) determines a climbing slope of the lamp type reset pulse (RP) by the time constant according to the resistance value and the capacitance. A slope of the limp type reset pulse (RP) determined by a designer can be adjusted by controlling the resistance value of the variable resistance (R).

The constant current circuit 551 constantly maintains the slop of the lamp type reset pulse (RP) by minimizing the change in the current flowing to the resistance (R) due tot he load variation.

The third driver IC (552) includes the fifth and sixth switches (SW5, SW6) that are connected as a push-pull type. Fifth and sixth switches (SW5, SW6) are respectively implemented as an N channel MOSFET and a P channel MOS FET, and control the amount of the voltage source (VDD) and the ground voltage (GND) supplied to the scan lines (S1, S2, . . . , Sm) in response to the voltage on the first node (N1).

Each gate terminal of the fifth and sixth switches (SW5, SW6) is connected to the first node (N1).

The source terminal of the fifth switch (SW5) is connected to the ground voltage source (GND), and its drain terminal is connected to the scan lines (S1, S2, . . . , Sm).

The source terminal of the sixth switch (SW6) is connected to the voltage source (VDD0 and its drain terminal is connected to the scan lines (S1, S2, . . . , SM).

A diode (D1) is serially connected between the first node (N1) and the scan liens (S1, S2, . . . , Sm). The diode (D1) stabilizes the operation of the fifth and sixth switches (SW5, SW6) by restraining a voltage variation on the first node (N1).

The operation of the reset pulse generating unit 560 constructed as described above will now be explained.

When the fourth switch (SW4) is turned off in the low logic section of the input pulse (IP), the voltage on the first node (N1) is increased according to the charged voltage of the capacitor (C).

When the voltage level is changed to more than a threshold voltage of the sixth switch (SW6) as the voltage on the first node N1) is increased, the sixth switch (SW6) is turned on and the second switch (SW2) is turned off.

Then, the voltage source (VDD) is supplied to the scan lines (S1, S2, . . . , Sm) by way of the source terminal and the drain terminal of the sixth switch(SW6).

The slop of the voltage source supplied to the scan lines (S1, S2, . . , Sm) is determined by the time constant according to the resistance value of the resistance (R) and the capacitance of the capacitor (C).

In other words, the lamp type reset pulse (RP) having a climbing slope determined by the RC time constant is supplied to the scan lines (S1, S2, . . . , Sm).

When the fourth switch (SW4) is turned on in the high logic section of the input pulse (IP), the voltage of the first node (N1) is discharged to the ground voltage (GND) and becomes low.

As the voltage on the first node becomes low, when the voltage level is changed to more than a threshold voltage of the fifth switch (SW5), the fifth switch (SW5) is turned on and the sixth switch (SW6) is turned off.

Then, the ground (GND) and the scan lines (S1, S2, . . . , Sm) are connected so that the voltage on the scan lines (S1, S2, . . . , Sm) is discharged to the ground (GND).

As a result, after scanning of the scan lines is completed, the voltage on the corresponding scan lines (S1, S2, . . . , Sm) is maintained at the ground (GND).

Figure 11:
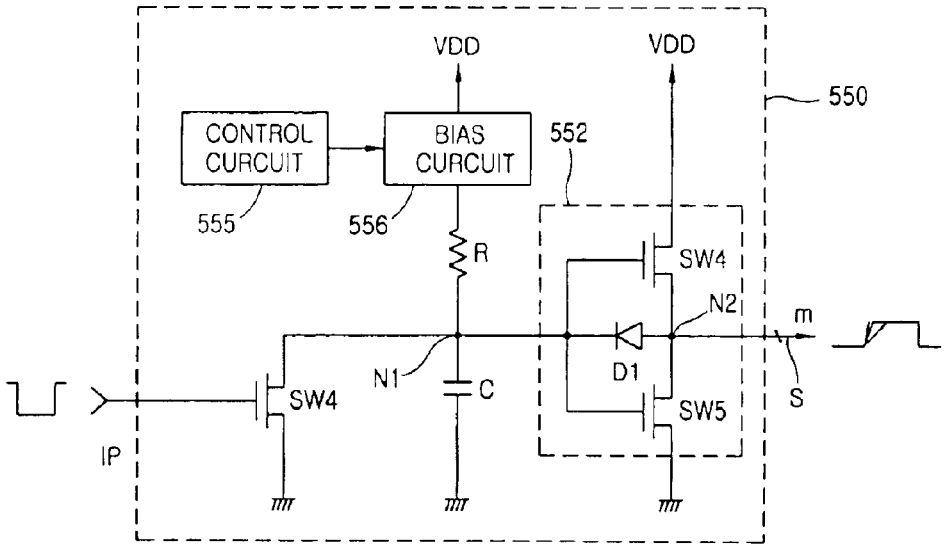
FIG. 11 is another circuit diagram of the reset pulse generating unit of the FET of FIG. 9.

FIG. 11 is another circuit diagram of the reset pulse generating unit of the FET of FIG. 9.

As shown in FIG. 11, a reset pulse generating unit 560 of an FET includes; a fourth switch (SW4) for receiving an input pulse (IP); a resistance (R) and a capacitor (C) connected in parallel to the fourth switch (SW4), a bias circuit (556) for responding to a control circuit and connected between the resistance (R) and a supply power (VDD); and a third driver IC 552 for selectively supplying the supply power (VDD) and the ground (GND) to the scan lines (S1, S2, . . . , Sm) in response to the voltage from the first node (N1).

The fourth switch SW4, fabricated as an N channel MOSFET, is turned on in the high logic section of the input pulse (IP) and turned off in the low logic section of the input pulse (IP).

As the fourth switch (SW4) is turned on, the voltage on the first node is discharged toward the ground (GND), and thus, its level becomes low.

And, as the fourth switch (SW4) is turned off, the capacitor (C) charges a voltage, for which, in the fourth switch, an input pulse (IP) is applied to the gate terminal and ground (GND) is applied to the source terminal. The drain terminal of the fourth switch (SW4) is connected to the first node (N10 between the resistance (R) and the capacitor (C).

The resistance (R) and the capacitor (C) determines a climbing slope of the lamp type reset pulse (RP) by the resistance value and a time constant. According to a capacitance. A slope of the limp type reset pulse (RP) determined by a designer can be controlled by varying a value of a current according to the capacitor (C) component of a cell as shown in equation (1):

$$I_p = C \times dv/dt. \quad (1)$$

The bias circuit 556 is connected between the resistance (R) and the supply power (VDD), and controls the slop of the lamp type reset pulse (RP) according to a capacitor of the cell in response to the control circuit 555.

The third driver IC (552) includes the fifth and sixth switches (SW5, SW6) that are connected as a push-pull type. Fifth and sixth switches (SW5, SW6) are respectively implemented as an N channel MOSFET and a P channel MOS FET and control the amount of the voltage source (VDD) and the ground (GND) supplied to the scan lines (S1, S2, . . . , Sm) in response to the voltage on the first node (N1).

Each gate terminal of the fifth and sixth switches (SW5, SW6) is connected to the first node (N1).

The source terminal of the fifth switch (SW5) is connected to the ground (GND), and its drain terminal is connected to the scan lines (S1, S2, . . . , Sm).

The source terminal of the sixth switch (SW6) is connected to the voltage source (VDD0 and its drain terminal is connected to the scan lines (S1, S2, . . . , SM).

A diode (D1) is serially connected between the first node (N1) and the scan liens (S1, S2, . . . , Sm). The diode (DI) stabilizes the operation of the fifth and sixth switches (SW5, SW6) by restraining a voltage variation on the first node (N1).

The operation of the reset pulse generating unit 560 constructed as described above will now be explained.

When the fourth switch (SW4) is turned off in the low logic section of the input pulse (IP), the voltage on the first node (N1) is increased according to the charged voltage of the capacitor (C).

When the voltage level is changed to more than a threshold voltage of the sixth switch (SW6) as the voltage on the first node N1) is increased, the sixth switch (SW6) is turned on and the fifth switch (SW5) is turned off.

Then, the voltage source (VDD) is supplied to the scan lines (S1, S2, . . . , Sm) by way of the source terminal and the drain terminal of the sixth switch(SW6).

The slop of the voltage source supplied to the scan lines (S1, S2, . . . , Sm) is determined by the time constant according to the resistance value of the resistance (R) and the capacitance of the capacitor (C).

In other words, the lamp type reset pulse (RP) having a climbing slope determined by the RC time constant is supplied to the scan lines (S1, S2, . . . , Sm).

When the fourth switch (SW4) is turned on in the high logic section of the input pulse (IP), the voltage of the first node (N1) is discharged to the ground (GND) and becomes low.

As the voltage on the first node becomes low, when the voltage level is changed to more than a threshold voltage of the fifth switch (SW5), the fifth switch (SW5) is turned on and the sixth switch (SW6) is turned off.

Then, the ground (GND) and the scan lines (S1, S2, . . . , Sm) are connected so that the voltage on the scan lines (S1, S2, . . . , Sm) is discharged to the ground (GND).

As a result, after scanning of the scan lines is completed, the voltage on the corresponding scan lines (S1, S2, . . . , Sm) is maintained at the ground (GND).

Figure 12:
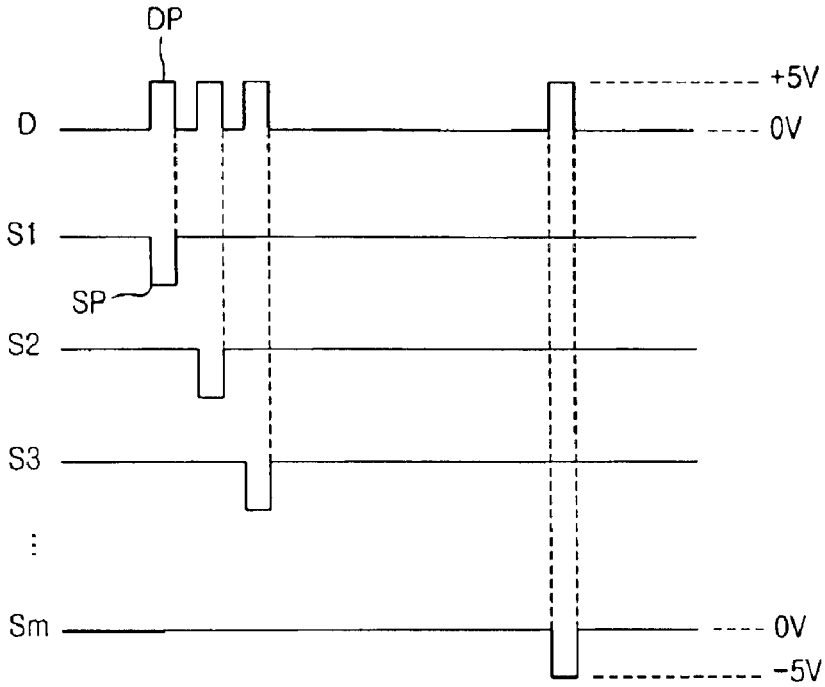
FIG. 12 is a drawing illustrating waveforms according to a driving method of a field emission display device in accordance with a fourth embodiment of the present invention.

FIG. 12 is a drawing illustrating waveforms according to a driving method of a field emission display device in accordance with a fourth embodiment of the present invention.

As shown in FIG. 12, in the FED, scan pulse of positive polarity is sequentially supplied to the scan lines (S1, S2, . . . , Sm), and the data pulse (DP) synchronized with the scan pulse (SP) is supplied to the data line (D).

The scan pulse (SP) supplied to the scan lines (S1, S2, . . . , Sm) has a voltage level of positive polarity of more than 0V.

The voltage level of the data pulse (DP) is set as a positive polarity voltage so strong as to emit electrons according to a voltage difference with the scan pulse (SP).

For example, when no scan pulse (SP) is supplied to the scan lines (S1, S2, . . . , Sm), 5V DC voltage is supplied to the scan lines (S1, S2, . . . , Sm).

Meanwhile, when the scan pulse is supplied, the scan pulse (SP) having a voltage level of 0V is supplied to the scan lines (S1, S2, . . . , Sm).

When no data pulse (DP) is supplied, a ground of 0V is supplied to the data lines (D), while when the data pulse (DP) is supplied, the data pulse 9DP) having a voltage level of 10V is supplied to the data lines (D).

Figure 13A:
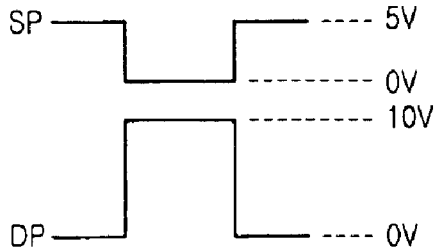
FIGS. 13A and 13B are detailed views showing waveforms of FIG. 12.
Figure 13B:
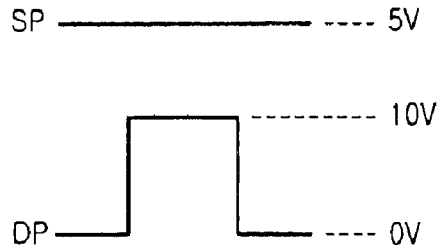

When the 0v scan pulse (SP) is supplied to the first scan line (SI) as shown in FIG. 13A, 10V data pulse (DP) is supplied to the data lines.

When the 10V data pulse (DP) is applied to the data lines (D), 10V voltage difference is generated at the first cells formed at the first scan line (S1) and electrons are emitted.

Meanwhile, 5V DC voltage is supplied to the second through the mth scan lines (S2, . . . , Sm) and 10V data pulse (DP) is supplied to the data lines (D).

Accordingly, 5V voltage difference is generated at the cells formed at the second through the mth scan lines (S2 through Sm). Meanwhile, no electrons are emitted from the second through the mth scan lines (S2 through Sm).

After the data pulse (DP) is supplied to the data liens (D), a certain blanking time (T) exists until the next data pulse (DP) is supplied. During the blanking time (T), a ground voltage is supplied to the data lines (D) and 5V DC voltage is supplied to the scan lines (S1, S2, . . . , Sm).

That is, since the logic value of the scan pulse (SP) and the data pulse (DP) are inverted, the electrons in the cell are eliminated by a reverse bias.

FIGS. 14A through 14D are drawings illustrating cell arrangements for explaining waveforms of FIG. 12.

Figure 14A:
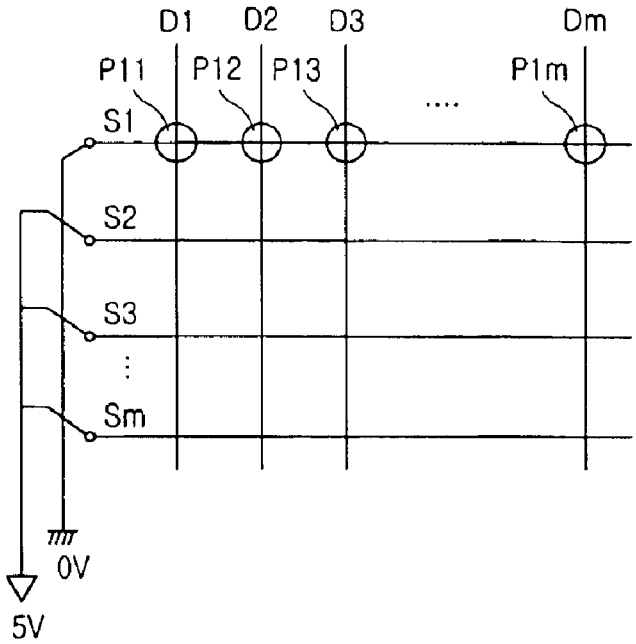
FIGS. 14A through 14D are drawings illustrating cell arrangement for explaining waveforms of FIG. 12.

As shown in FIG. 14A, 0V is supplied to the first scan line (S1) of each cell, and 5V voltage is applied to the second through the mth scan liens (S2 through Sm).

Since 0V data pulse (DP) is applied to the cells (p11 through P1*n*) formed at the first scan line (S1), no electrons are emitted from the first scan line (S1) and the data pulse (DP).

That is, since the second through the mth scan lines (S2 through Sm) are maintained at the 5V voltage level, no electrons are emitted from the cells formed at the second through the mth scan lines (S2 through Sm).

Figure 14B:
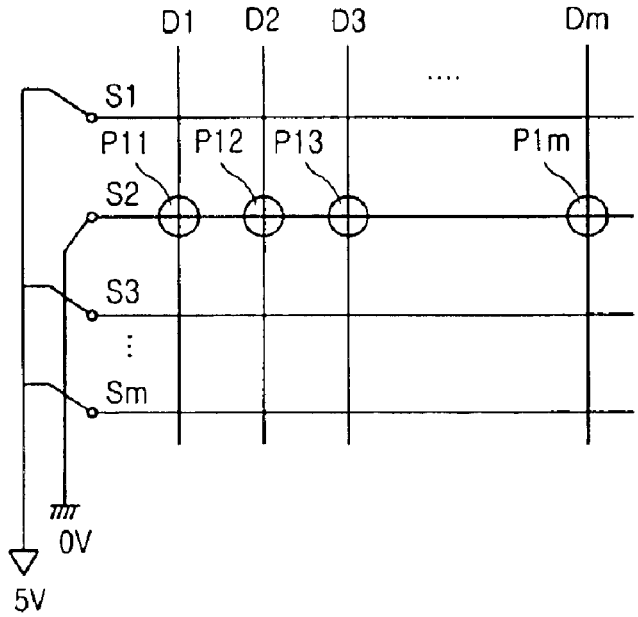

Subsequently, as shown in FIG. 14B, 0V is supplied to the second scan line (S2) of each cell, and 5V voltage is applied to the scan lines (S1, S2, . . . , Sm) except the second scan line (S2).

When the scan pulse (SP) is applied to the second scan line (S2), 10V data pulse (DP) is applied to the 21 cell (P21) and the 23 cell (P23) among the cells formed at the second scan line (S2) and electrons are emitted.

Meanwhile, 0V data pulse is applied to the 22 cell (P22) and the 24 through the 2*n* cell (p24 through P2*n*) among the cells formed at the second scan line (S2), so that no electrons are emitted.

The scan lines (S1, S2, . . . , Sm), except the second scan line (S2) has a 5V voltage level, no electrons are emitted from the cells formed at the scan lines (S1, S2, . . . , Sm) except the second scan line (S2).

Figure 14C:
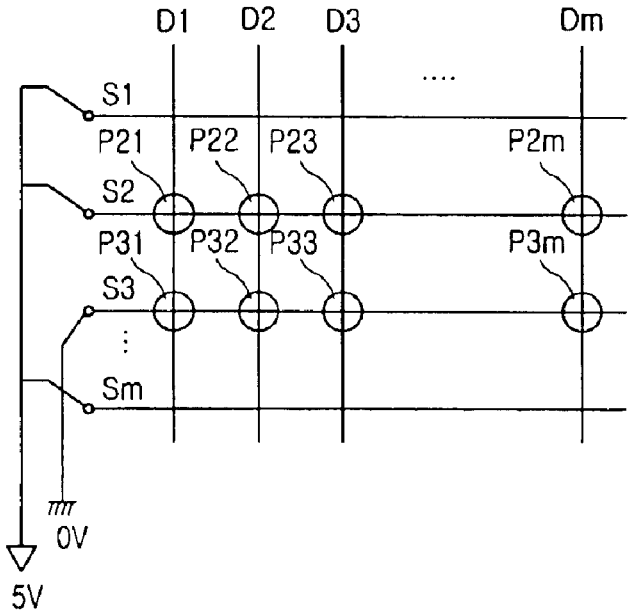

As shown in FIG. 14C, 0V is sequentially supplied to the third scan line (S3) of each cell, and 5V voltage is applied to the scan liens (S1, S2, . . . , Sm) except the third scan line (S3).

When the scan pulse (SP) is applied to the third scan line (S3), 10V data pulse 10V voltage difference is generated at the $31^{st}$ through 3*n* cell (P31 through P3*n*) formed at the third scan lines (S1, S2, . . . , Sm) to which 10V data pulse has been applied, so that electrons are emitted.

Since the scan lines (S1, S2, . . . , Sm), except the third scan line (S3), has a 5V voltage level, no electrons are emitted from the cells formed at the scan liens (S1, S2, . . . , Sm) except the third scan line (S3).

Figure 14D:
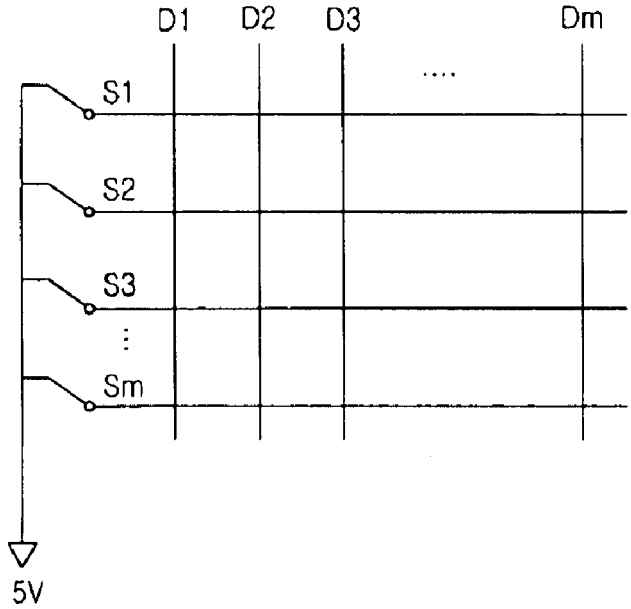

FIG. 14D is a drawing illustrating an operation of the cell during the blanking time between FIG. 14B and FIG. 14C.

As shown in FIG. 14D, as the scan pulse (SP) is sequentially applied to the second scan line (S2) and the third scan line (S3) of each cell, a blanking time exists between the second scan line (S2) and the third scan line (S3).

During the blanking time, 5V voltage, higher than the voltage of the data pulse (DP) is applied to the first through the mth scan liens (S1, S2, . . . , Sm). Accordingly, a reset process is performed that the electric charges accumulated in the cells formed at the first through the mth scan lines (S1, S2, . . . , Sm) during the blanking time are discharged.

Figure 15:
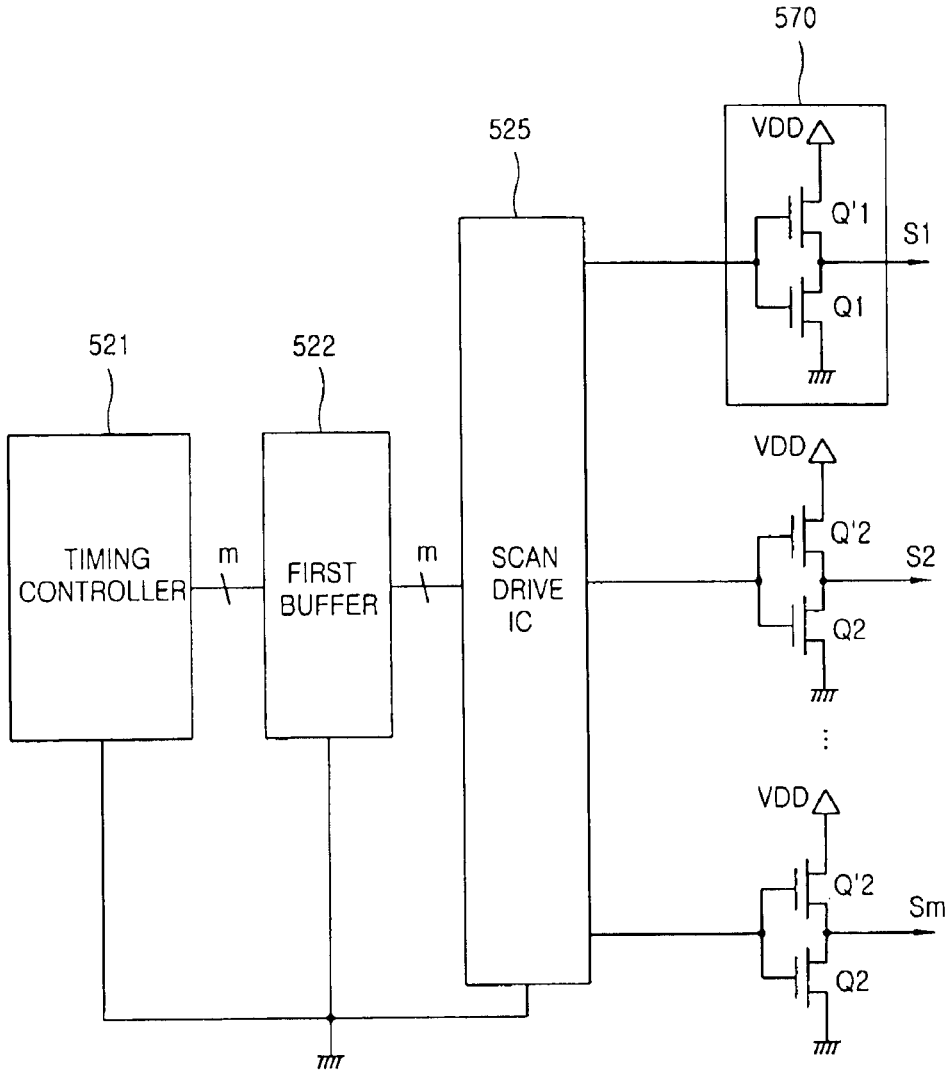
FIG. 15 is a circuit diagram for driving the scan pulse of FED generating waveforms of FIG. 12.

FIG. 15 is a circuit diagram for driving the scan pulse of FED generating waveforms of FIG. 12.

As shown in FIG. 15, a scan pulse driving circuit of the FED includes a timing controller 521 for supplying a scanning data according to a supply timing of the scan pulse (SP); a first buffer 522 for temporarily storing the scanning data; a scan drive IC 525 for receiving the scanning data from the first buffer 522 and sequentially supplying the scan pulse (SP) to the scan lines (S1, S2, . . . , Sm); and a reset pulse supplying unit 570 for selectively flowing the scan pulse to the first through the mth scan lines (S1, S2, . . . , Sm).

The timing controller 521 supplies the scanning data to the first buffer 522 at certain intervals so that the scan pulse (SP) can be sequentially supplied to the scan lines (S1, S2, . . . , Sm).

The first buffer 522 temporarily stores the scanning data and supplies the stord data to the scan drive IC 525.

The scan drive IC 525 is connected to the first through the mth scan liens (S1, S2, . . . , Sm), and the scan drive IC 525 applies a drive signal to the first through the mth scan lines (S1, S2, . . . , Sm) so as to be synchronized with the data signal applied to the data line.

The reset pulse supplying unit 570 includes two field effect transistors (FET) that are connected as a push-pull type. The first FET (Q'1) is a P channel device and a second FET is an N channel device.

When a scan pulse (SP) of negative polarity is sequentially applied to the first through the mth scan lines (S1, S2, . . . , Sm), the P channel FETs (Q'1, Q'2, . . . , Q'm) of the reset pulse supplying unit 570 of the corresponding scan lines (S1, S2, . . . , Sm) are conducted and the N channel FETs (Q1, Q2, . . . , Qm) are cut off.

A gate of the first FET (Q'1) is connected to the first through the mth scan liens (S1, S2, . . . , Sm) and a gate of the second FET (Q1), and its drain is connected to the voltage source (VDD). A source of the first FET (Q'1) is connected to the drain of the second FET(Q1 ) and the first through the mth scan lines (S1, S2, . . . , Sm).

The gate of the second FET (Q1) is connected to the first through the mth scan liens (S1, S2, . . . , Sm) and the gate of the first FET(Q'1) and its drain is connected to the source of the first FET(Q'1) and the first through the mth scan liens (S1, S2, . . . , Sm), The drain is also grounded.

The driving circuit constructed as described above is a modification of the scan driving unit 520 as illustrated in FIG. 6. The driving circuit is different from the scan driving unit 520 in that the former grounds the scan drive IC 525 rather than supplying −VDD to the scan drive IC 525, and does not use a photocoupler 523 and the second buffer 524.

The operation of the driving circuit of the FED will now be explained.

First, the scan pulse (SP) in synchronization with the data pulse (DP) of the data line (D) is supplied only to the first scan line (S1) from the scan drive IC 525.

At this time, the first FET (Q'1) is turned on and the second FET (Q1) is turned off, so that 5V voltage is applied to the first scan line.

In order to apply 0V voltage to the first scan line, the first FET (Q'1) is turned off while the second FET (Q1) is turned on.

At the same time, the first FET(Q'1) of the scan pulse supply unit of the scan lines (S2 through Sm) except the first scan line (S1) is turned off and the second FET (Q1) is turned on. Accordingly, only the first scan line (S1) can apply a current to the cell through the scan lines (S2, . . . , Sm) by the operation of the FET and the voltage source (VDD).

The above described embodiments can be also adopted to a flat display panel driven in a matrix form as well as the field emission display device.

As so far described, the field emission displaying device and its driving method in accordance with the present invention has many advantages.

That is, first, by applying the lamp type reset pulse having a slope to the scan line, the displacement current of the instantaneous peak current can be reduced. Thus, a damage to the insulation layer between the data electrode and the scan electrode can be prevented. And accordingly, the life span of the cell can be prolonged and the device of the driving IC can be prevented from breaking down.

Secondly, since the reset operation is performed without a reset pulse, a power consumption can be reduced, and the life span of the electrode can be prolonged by preventing an insulation breakdown of the cell.

Thirdly, after the scan pulse is supplied to one scan line, the reset pulse is supplied to every scan line. Thus, a uniformity of cell can be obtained. And since every cell is driven in the uniform state, the picture quality and efficiency of the field emission display device can be improved.

Lastly, after the scan pulse is supplied to every scan line, at least more than two reset pulses are supplied to the scan lines. Thus, the electric charges charged in the cell can be all removed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A field emission display device comprising:

a reset driving unit for supplying a reset pulse to a scan line; and a scan driving unit for supplying a scan pulse to the scan line, wherein the reset pulse refers to a plurality of reset pulses which are supplied to each scan line, and wherein the reset driving unit comprises:

a first reset drive IC for receiving a first reset data from a reset data supplying unit;

a second reset drive IC for receiving a second reset data from the reset data supplying unit;

a first switch connected to the first reset drive IC and turned on/off by the first reset drive IC; and a second switch connected to the second drive IC and turned on/off by the second reset drive IC.

2. The device of claim 1, wherein the first reset drive IC and the first switch are connected to a voltage source of positive polarity, and the second reset drive IC and the second unit are connected to a ground.

3. The device of claim 2, wherein the first switch is turned on whenever the scan pulse is supplied to one scan line, to supply the voltage of positive polarity to every scan line.

4. The device of claim 2, wherein the second switch is turned on when no scan pulse and no reset pulse is supplied to the scan line.

5. The device of claim 2, wherein the first switch is turned on at least more than twice after the scan pulse is supplied to every scan line, so as to supply the voltage of positive polarity to every scan line.

6. The device of claim 1, further comprising:

a resistance having a certain resistance value between the scan line and the reset driving unit.

7. The device of claim 1, wherein the scan driving unit comprises:

a timing controller for supplying a scanning data according to a supply timing of the scan pulse;

a first buffer for temporarily storing the scanning data;

a photocoupler for electrically insulating the first buffer and a second buffer;

the second buffer for temporarily storing the scanning data received from the photocoupler; and a scan drive integrated circuit (IC) for receiving the scanning data from the second buffer and sequentially supplying the scan pulse to the scan lines.

8. The device of claim 1, wherein the scan driving unit comprises:

a reset pulse generator for determining a slope of the reset pulse so that the reset pulse may have a certain slope.

9. The device of claim 8, wherein the reset pulse generator comprises a resistance and a capacitor connected between a voltage source and a ground voltage.

10. The device of claim 9, wherein the reset pulse generator comprises:

a first switch having a gate terminal receiving an input pulse, a source terminal receiving the ground voltage and a drain connected to a first node;

a second switch having a gate terminal connected to the first node, a source terminal connected to the ground voltage, and a drain terminal connected to the scan line; and a third switch having a gate terminal connected to the first node, a drain terminal connected to the voltage source, and a source terminal connected to the scan line.

11. The device of claim 10, further comprising:

a diode connected between the first node and the scan line.

12. The device of claim 10, further comprising:

a constant current circuit for constantly maintaining a current applied to the resistance.

13. The device of claim 10, further comprising:

a bias circuit connected to control the slope value of the reset pulse in response to a control circuit.

14. The device of claim 1, wherein the scan driving unit comprises:

a timing controller for supplying a scanning data according to a supply timing of the scan pulse;

a first buffer for temporarily storing the scanning data;

a scan drive IC for receiving the scanning data from the first buffer and sequentially supplying the scan pulse to the scan lines; and a reset pulse supplying unit for selectively flowing the scan pulse to the plurality of scan lines.

15. The device of claim 14, wherein the reset pulse supplying unit includes two field effect transistors that are connected as a push-pull type.

16. The device of claim 1, wherein the reset driving unit comprises:

a first reset drive IC for receiving a first reset data from a reset data supplying unit;

a second reset drive IC for receiving a second reset data from the reset data supplying unit;

a first switch connected to the first reset drive IC and turned on/off by the first reset drive IC; and a second switch connected to the second drive IC and turned on/off by the second reset drive IC.

* * * * *